US005420425A

United States Patent [19]

Bier et al.

[11] Patent Number: 5,420,425

[45] Date of Patent: May 30, 1995

[54] ION TRAP MASS SPECTROMETER SYSTEM AND METHOD

[75] Inventors: Mark E. Bier, Menlo Park; John E. P. Syka, Sunnyvale, both of Calif.

[73] Assignee: Finnigan Corporation, San Jose, Calif.

[21] Appl. No.: 250,156

[22] Filed: May 27, 1994

[51] Int. Cl.[6] ..... H01J 49/42

[52] U.S. Cl. ..... 250/292; 250/291; 250/283; 250/282

[58] Field of Search ..... 250/292, 291, 290, 283, 250/282

[56] References Cited

U.S. PATENT DOCUMENTS

| | | | |
|---|---|---|---|
| 3,555,273 | 1/1971 | Arnold | 250/41.9 |
| 4,540,884 | 9/1985 | Stafford et al. | 250/282 |
| 5,206,506 | 4/1993 | Kirchner | 250/281 |

OTHER PUBLICATIONS

Ion Confinement in the Collision Cell of a Multiquadrupole Mass Spectrometer 1989 American Chemical Society, pp. 1447–1453.

Quadrupole Mass Spectrometry, P. H. Dawson.

Laser Photodissociation Probe for Ion Tomography Studies in a Quadrupole Ion–Trap Mass Spectrometer, Chem. Phys Letters, vol. 191, No. 5, pp. 405–410.

Ion–Trapping Technique for Ion/Molecular Reaction Studies in the Center Quadrupole of a Triple Quadrupole Mass Spectrometer, Int. Jrnl. of Mass Spectrometry, 82 (1988).

Storage–Ring Ion Trap Derived from the Linear Quadrupole Radio–Frequency Mass Filter, Church, Jrnl. of Applied Physics, vol. 40, pp. 3127–3134.

*Primary Examiner*—Jack I. Berman

*Attorney, Agent, or Firm*—Flehr, Hohbach, Test, Albritton & Herbert

[57] ABSTRACT

The present invention relates generally to an ion trap mass spectrometer for analyzing ions and more particularly to a substantially quadrupole ion trap mass spectrometer with an enlarged ion occupied volume. Described herein are electrode geometries that enlarge the ion occupied volume. Improved ion sensitivities, detection limits and dynamic range should be realized for the same charge density in these devices because the increased ion occupied volume allows for the storage of a greater number of ions. The essence of this invention is that these ion trap geometries may apply all modes of operation of substantially quadrupole ion traps such as the mass selective instability mode, resonance excitation/ejection, and $MS^n$.

29 Claims, 13 Drawing Sheets

EQUATION FOR X-Z PLANE ASYMPTOTES $$Z = \pm \left(1 + \left(\frac{X_0}{Y_0}\right)^2\right)^{-1/2} X$$

EQUATION FOR Y-Z PLANE ASYMPTOTES $$Z = \pm \frac{X_0}{Y_0} \left(1 + \left(\frac{X_0}{Y_0}\right)^2\right)^{-1/2} Y$$

ION TRAP MASS SPECTROMETER SYSTEM AND METHOD

BRIEF SUMMARY OF THE INVENTION

The present invention relates generally to an ion trap mass spectrometer for analyzing ions and more particularly to a substantially quadrupole ion trap mass spectrometer with various geometries for improved performance and methods to use the various geometries with various scanning techniques of mass analysis.

BACKGROUND OF THE INVENTION

Quadrupole ion trap mass spectrometers have been known for many years and were described by Paul and Steinwedel in U.S. Pat. No. 2,939,952. Ion traps are devices in which ions are introduced into or formed and contained within a trapping chamber formed by at least two electrode structures by means of substantially quadrupolar electrostatic fields generated by applying RF voltages, DC voltages or a combination thereof to the electrodes. To form a substantially quadrupole field, the electrode shapes have typically been hyperbolic.

Mass storage and analysis are generally achieved by operating the ion trap electrodes with values of RF voltage V, RF frequency f, DC voltage U, and device size $r_0$ such that ions having their mass-to-charge ratios (m/e) within a finite range are stably trapped inside the device. The aforementioned parameters are sometimes referred to as trapping or scanning parameters and have a relationship to the m/e ratios of the trapped ions.

Quadrupole devices are dynamic. Instead of constant forces acting on ions, ion trajectories are defined by a set of time-dependent forces. As a result, an ion is subject to strong focusing in which the restoring force, which drives the ion back toward the center of the device, increases linearly as the ion deviates from the center. For two-dimensional ion trap mass spectrometers, the restoring force drives the ion back toward the center axis of the device.

The motion of ions in quadrupole fields is described mathematically by the solutions to a particular second-order linear differential equation called the Mathieu equation. Solutions are developed for the general ease, the two-dimensional case of the quadrupole mass filter, and the standard three-dimensional case of the quadrupole ion trap. Thus, in general, for any direction u where u represents x, y, or z, $$a_u = \frac{K_a eU}{m r_0^2 \omega^2}$$

$$q_u = \frac{K_q eV}{m r_0^2 \omega^2}$$

where

V=magnitude of radio frequency (RF) voltage

U=amplitude of applied direct current (d.c.) voltage e=charge on an ion m=mass of an ion $r_0$=device-dependent size $\omega=2\pi f$ f=frequency of RF voltage $K_a$=device-dependent constant for $a_u$ $K_q$=device-dependent constant for $q_u$ Stability diagrams which represent a graphical illustration of the solutions of the Mathieu equation utilize $a_u$ as the ordinate and $q_u$ as the abscissa.

For a substantially quadrupole field defined by U, V, $r_0$ and $\omega$ the locus of all possible m/e ratios maps onto the stability diagram as a single straight line running through the origin with a slope equal to $-2U/V$. This locus is also referred to as the scan operating line. For ion traps, the portion of the locus that maps within the stability region defines the range of ions that are trapped by the applied field.

FIG. 1 shows a stability diagram representative of the operation of a two-dimensional ion trap mass spectrometer. Knowledge of the diagram is important to the understanding of the operation of quadrupole ion trap mass spectrometers. The stable ion region is cross-hatched and shown bounded by $\beta_x$ and $\beta_z$.

The ion masses that can be trapped depend on the numerical values of the trapping parameters U, V, $r_0$ and $\omega$. The relationship of the trapping parameters to the m/e ratio of the ions that are trapped is described in terms of the parameters "a" and "q" in FIG. 1. The type of trajectory a charged ion has in a quadrupole field depends on how the specific m/e ratio of the ion and the applied trapping parameters, U, V, $r_0$ and $\omega$ combine to map onto the stability diagram. If these trapping parameters combine to map inside the stability envelope then the given ion has a stable trajectory in the defined field.

By properly choosing the magnitudes of U and V, the range of specific masses of trappable ions can be selected. If the ratio of U to V is chosen so that the locus of possible specific masses maps through an apex of the stability region, then only ions within a very narrow range of specific masses will have stable trajectories. However, if the ratio of U to V is chosen so that the locus of possible specific masses maps through the "middle" ($a_u=0$) of the stability region, then ions of a broad range of specific masses will have stable trajectories.

Ions having a stable trajectory in a substantially quadrupole field are constrained to an orbit about the center of the field. Typically, the center of the field is substantially along the center of the trapping chamber. In essence, the stable ions converge toward the center of the quadrupole field where they form a "cloud" of ions constantly in motion about the center of the quadrupole field. Although the intensity of the quadrupole field decreases from locations near the electrode surface to the center of the quadrupole field, ion density (with respect to the ion occupied volume, not the volume of the trapping chamber) increases. Such ions can be thought of as being trapped by the quadrupole field. Hereinafter, ion occupied volume is defined as the smallest volume occupied by most of the trapped ions. Typically, 95% of the ions in the trapping chamber occupy this volume. The ion occupied volume is smaller than the trapping chamber.

If, for any ion m/e ratio, U, V, $r_0$, and $\omega$ combine to map outside the stability envelope on the stability diagram, the given ion has an unstable trajectory in the defined field. Ions having unstable trajectories in a substantially quadrupole field attain displacements from the center of the field which approach infinity over time. Such ions can be thought of as escaping the field and are consequently considered untrappable.

For both two-dimensional and three-dimensional ion trap mass spectrometers, some performance criteria must be used to determine their quality as a point of reference. Five important performance criteria are signal-to-noise ratio, sensitivity, detection limit, resolution, and dynamic range. The design of any ion trap mass spectrometer must take these criteria into consideration. Additionally, negative effects due to space charge cannot be ignored.

A parameter that plays a significant role in the performance of ion trap mass spectrometers is the number of ions (N) trapped in the electrode structure. Under equivalent conditions, a greater number of ions (N) improves performance. The number of ions (N) is given by the relation:

$$N=\rho v$$

where v is the ion occupied volume and $\rho$ is the average charge density. Since the charge density $\rho$ should be maintained as a constant to minimize the effects of space charge, only the ion occupied volume v can be increased to increase the total number of ions stored in the ion trap mass spectrometer. Merely increasing the volume of the trapping chamber in the radial direction (along the x- and/or z-axes) will not increase the ion occupied volume. The many embodiments of the present invention provide solutions to increasing the ion occupied volume v.

However, one limitation on increasing the trapping chamber radially (in a direction substantially parallel to the x-z plane) as opposed to axially (in a direction along the y-axis) is the restoring potential. For example, in a two-dimensional straight substantially quadrupole ion trap mass spectrometer, if the volume of the trapping chamber is increased arbitrarily in the radial direction (x and z directions), the restoring potential may not be suitable to contain the high m/e ions. To maintain the same restoring potential or achieve a suitable field, the power supply voltages must be increased, effectively defining the original substantially quadrupole field. But, as the embodiments of the present invention will show, if the volume of the trapping chamber is increased in the axial or non-radial direction (y direction) only, the power supply voltages need not be changed or increased. Thus, increasing the volume in the y direction increases the number of trapped ions, and improves the performance of the ion trap mass spectrometer.

Another limitation of increasing the volume of the trapping chamber in the radial direction is the mass range of ions trappable in the ion trap mass spectrometer. As the volume of the trapping chamber is increased radially, the trappable ion mass range decreases. This is because the maximum mass range is inversely proportional to the square of the device-dependent parameter $r_0$ (that is, $m_{max}\ \alpha 1/r_0^2$). Thus, as the volume of the trapping chamber is increased non-radially (in the y direction) only, $r_0$ is not affected and thus, the same mass range of ions can be maintained.

For two-dimensional substantially quadrupole fields, no field exists in the y direction. So, from the general expression of $\phi$ for the substantially quadrupole field, $$\phi = \frac{\phi_0}{r_0^2}(\lambda x^2 + \gamma z^2)$$

where $\sigma=0$.

From Laplace's condition, $$\lambda+\gamma=0$$

and so, $$\lambda=-\gamma=1$$

As is well known in the art, the choice of 1 in the last equation is arbitrary. The substantially quadrupole field then becomes:

$$\phi(x,y) = \frac{\phi_0}{r_0^2}(x^2 - z^2)$$

The two-dimensional substantially quadrupole fields can be generated by straight or curved electrodes. The most desirable surface of the rod-like electrodes is hyperbolic in shape.

The equation for the substantially quadrupole field for the three-dimensional ion trap can be derived by simply incorporating particle motion in the y direction. The simplest three-dimensional ion trap is defined by two end electrodes and a center ring electrode. The substantially quadrupole field within the ion trap exists in all three directions (x, y, z). As before, utilizing the general expression for the substantially quadrupole field and satisfying Laplace's condition, the potential $\phi$ at any point (x, y, z) is:

$$\phi(x,y,z) = \frac{\phi_0}{r_0^2}(\lambda x^2 + \sigma y^2 - 2\gamma z^2)$$

Thus, for a particular applied potential $\phi_0$ and device size $r_0$, the potential $\phi$ may be obtained at any point (x, y, z). For greater device size $r_0$, the same applied potential $\phi_0$ will result in a smaller field $\phi$ at the same point (x, y, z). This, in effect, reduces the mass range of the ion trap mass spectrometer. As the device size $r_0$ increases, the field at the same point (x, y, z) decreases and the restoring field will not be sufficient to drive the high m/e ions back toward the central axis. In order to have a sufficient restoring field, one must increase $\phi_0$. Under some conditions, the limits on $\phi_0$ may warrant replacing the power supplies to that which provide higher voltages. However, as the embodiments of the present invention will show, increasing the volume of the trapping chamber by increasing the dimensions in the y-direction only and effectively creating an ellipse-shaped electrode structure also enlarges the ion occupied volume.

Space charge is the perturbation in an electrostatic field due to the presence of an ion or ions. This perturbation forces the ion to follow trajectories not predicted by the applied field. If the perturbation is great, the ion may be lost and/or the mass spectral quality may degrade. Spectral degradation refers to broad peaks giving lower resolution (m/Δm), a loss of peak height reducing the signal-to-noise ratio, and/or a change in the measured relative ion abundances. Space charge thus limits the number of ions one can store while still maintaining useful resolution and detection limits.

The novel ion trap mass spectrometers disclosed herein are used with a number of mass analysis methods. One embodiment of this method, the mass selective instability scan, is described in U.S. Pat. No. 4,540,884, which is incorporated herein by reference. In this method, a wide mass range of ions of interest is created and stored in the ion trap during an ionization step. The RF voltage applied to the ring electrode of the substantially quadrupole ion trap is then increased and trapped ions of increasing specific masses become unstable and either exit the ion trap or collide on the electrodes. The ions that exit the ion trap can be detected to provide an output signal indicative of the m/e (mass to charge ratio) of the stored ions and the number of ions.

An enhanced form of the mass selective instability scan incorporates resonance ejection. Refer to U.S. Pat. Nos. 4,736,101 and Re. 34,000. They demonstrate that introducing a supplemental AC field in the ion trap mass spectrometer facilitates the separation and ejection of adjacent m/e ions. The frequency $f_{res}$ of the supplemental AC source determines the $q_u$ at which ions will be ejected. If the frequency $f_{res}$ of the supplemental AC field matches a secular component frequency of motion of one of the m/e ion species in the ion occupied volume, the supplemental field causes those specific ions (e.g., those ions at the specific q) to oscillate with increased amplitude. The magnitude of the supplemental field determines the rate of increase of the ion oscillation. Small magnitudes of the supplemental field will resonantly excite ions, but they will remain within the substantially quadrupole field. Large magnitudes of the supplemental field will cause those ions with the selected resonant frequency to be ejected from or onto the trapping chamber. In some commercial ion traps, a value of 2 to 10 volts peak-to-peak measured differentially between the two end caps have been used to resonantly eject ions.

The frequency of the supplemental AC field $f_{res}$ is selected such that the ions of specific m/e ratios can develop trajectories that will make the ion leave the ion occupied volume. The resonant frequency $f_{res}=kf\pm f_u$ where, k=integer where k={0, ±1, ±2, ±3, . . . } f=frequency of the RF component of the substantially quadrupole field $f_u$=fundamental frequency for the secular motion of a given ion at $q_{u\ eject}$ along the u coordinate axis, and $f_u<f$.

The expression for $f_{res}$ represents the frequency components of the solutions of the exact equations of ion motion in a harmonic RF potential. Typically, k=0 so that $f_{res}=f_u$ and smaller applied AC amplitude potentials are required; however, any frequency satisfying the general expression for $f_{res}$ and of sufficient amplitude will cause ions to leave the trapping chamber.

A supplemental field can also be used with the MS/MS method, described in U.S. Pat. Nos. 4,736,101 and Re. 34,000, which are incorporated herein by reference. Essentially, MS/MS involves the use of at least two distinct mass analysis steps. First, a desired m/e is isolated (typically with a mass window of ±0.5 amu). Ejection of undesired ions during the isolation step is accomplished by, and not limited to, several techniques: (i) applying DC to the ring, (ii) applying waveforms, and (iii) scanning the RF so that undesirable ions pass through and are ejected by a resonance frequency. This is $MS^1$. After undesired ions are ejected, the RF (and possibly DC) voltage is lowered to readjust the m/e range of interest to include lower m/e ions. Fragments, or product ions can then be formed when a neutral gas, such as helium, argon, or xenon, is introduced in the ion trapping chamber in combination with a resonance excitation potential applied to the end caps. These fragments remain in the ion trapping chamber. In the second mass analysis step, the mass selective instability scan is used, with or without resonance ejection, to eject the fragment ions into a detector. This is $MS^2$. Thus, at least two mass spectrometry steps were performed in one device. Repetitive tandem MS techniques (i.e. $(MS)^n$) may also be employed for n distinct mass spectrometry steps.

The $MS^2$ step can be accomplished as follows: A supplemental AC field is applied after the primary RF field is decreased at the end of the first scan and prior to the second scan to eject undesired ions of a specific m/e ratio. Upon ejection, the supplemental AC field is turned off and the primary RF field is increased to eject desired ions into a detector. Variations of this technique, as disclosed in U.S. Pat. Nos. 4,736,101 and Re. 34,000, can be utilized. Thus, manipulation of the RF amplitude, RF frequency, supplemental AC field amplitude, supplemental AC field frequency, or a combination thereof promotes ejection of ions for detection after the formation and trapping of product ions. For example, the supplemental AC field can be turned on during the second scan of the primary RF field. Alternatively, instead of a second scan period, the RF field is kept constant while the frequency of the supplemental AC field is varied. Ejection can also be achieved by changing the magnitude of the supplemental AC field while changing the amplitude of the RF component of the substantially quadrupole field.

Several people have trapped ions in a two-dimensional RF-quadrupole. Beaugrand, Devant, Mestdagh, Jaouen, and Rolando trapped and stored ions in a RF-quadrupole and showed the trapping efficiency to be quite high. C. Beaugrand, G. Devant, H. Mestdagh, D. Jaouen, and C. Rolando, 5 Spectroscopy Int. J. 265 (1987). The trapping of ions in a substantially quadrupole field is further discussed in U.S. Pat. No. 4,755,670 where a Fourier transform method of analysis is taught by Syka and Fies. Dolnikowski, Kristo, Enke, and Watson have also trapped ions in a RF-quadrupole where they studied ion/molecule reactions. G. G. Dolnikowski, M. J. Kristo, C. G. Enke and J. T. Watson, 82 Int. J. of Mass Spectrom. and Ion Proc. 1 (1988). After the ion molecule reactions occurred in the storage cell, these ions were pulsed into a quadrupole mass filter for mass analysis. Beaugrand and co-workers also studied the chemical equilibrium and kinetic and thermodynamic parameters of select ion/molecule reactions. C. Beaugrand, D. Jaouen, H. Mestdagh, and C. Rolando, 61 Anal. Chem. 1447 (1989). This instrument consisted of three quadrupoles where the central quadrupole served as a storage and reaction cell. In all of these cases the ions were never scanned out of the quadrupole using the mass selective instability scan mode.

Curved ion traps have also been explored. In 1969 Church described a ring ion trap and a "racetrack" ion trap geometry. The ring ion trap was formed by bending the more typical two-dimensional quadrupole rod electrodes into a circle. D.A. Church, 40 Journal of Applied Physics 3127 (1969). Church worked at a high fundamental frequency, 52 Mhz, a small $r_0$=0.16 cm (distance from the center of the field to the edge of a quadrupole rod), and R=7.2 cm (radius of the ring structure). This made $R/r_0$=45 which is relatively large. The large $R/r_0$ allowed the field formed in this circular ion trap to more closely mimic an ideal two-dimensional substantially quadrupole field. That is, by minimizing the effects of the induced multipole fields the non-two-dimensional resonances are reduced and trapping time is maximized. Church was able to trap and measure the presence of $H^+$(m/e=1), $_3He^+$(m/e=3), and noted that "heavier ions" $Hg^{+}$(m/e=200.6) and $Hg^{+2}$ (m/e=100.3) could also be trapped as described by G. R. Hugget and S. C. Menasian. The detection of ions in Church's work was accomplished using a resonance absorption technique. No helium damping gas was added to their device.

U.S. Pat. No. 3,555,273 (issued to James T. Arnold) describes a three-dimensional quadrupole structure. However, the structure described and claimed is a mass filter.

Other ion traps with six-electrode structures have been studied. These six-electrode ion traps have been described with flat plats and annular rings, but using hyperbolic electrodes is preferred. These structures could be scanned using the mass selective instability scan mode as in the three-electrode counterpart or the straight two-dimensional quadrupole as stated here.

Applicant is not aware of any prior art that attempts to improve the performance of ion trap mass spectrometers in the manner herein disclosed. The geometries with an elongated trapping chamber forming the enlarged ion occupied volume and the particular detection scheme have not been used with the mass-selective instability scan mode with or without resonance excitation ejection waveform.

SUMMARY OF THE INVENTION

An object of the present invention is to provide an ion trap mass spectrometer having increased or enlarged ion occupied volume, and thus increasing the number of ions trapped without an increase in the charge density.

Another object of the present invention is to use the mass selective instability scan mode of operation with the enlarged ion trap mass spectrometer.

A further object of the present invention is to supplement the mass selective instability scan mode of operation with a supplemental or an auxiliary resonance excitation ejection field.

The foregoing and other objects of the present invention are achieved by an ion trap mass spectrometer having an enlarged ion occupied volume. By elongating the trapping chamber, an enlarged ion occupied volume is provided which increases the number of ions which can be trapped without an increase in charge density. Increasing the number of ions orbiting about the center of the substantially quadrupole field without increasing the average charge density is also an embodiment of the present invention. Accordingly, signal-to-noise ratio (S/N), sensitivity, detection limit, and dynamic range will improve without an increase in the negative effects of space charge. Additionally, since the trapping chamber can be elongated without any increase in the device size $r_0$, the same power supply may be used. Various geometries of the ion trap mass spectrometer are possible for the present invention.

With these geometries, the mass selective instability scan mode with and without a supplemental or an auxiliary resonance ejection field is used as one method of mass analysis. Ions will be ejected out of the trapping chamber in a direction orthogonal to the center axis, an axis along the center of the trapping chamber. Ions may be ejected between electrode structures or through apertures in the electrode structures for detection. $MS^n$ is also used with these devices.

BRIEF DESCRIPTION OF THE DRAWINGS

Advantages and features of the present invention may be better understood with the description and accompanying drawings in which:

FIGS. 4A, 4B, and 4C show a third embodiment of the present invention comprising a circular ion trap mass spectrometer with an enlarged ion occupied volume and a two-dimensional substantially quadrupole field wherein FIG. 4A is a left side view of the circular ion trap mass spectrometer showing the entrance aperture, FIG. 4B is a cross-sectional view along an imaginary plane through the center of the ion trap mass spectrometer and normal to the circular faces of the ion trap mass spectrometer, and FIG. 4C is a right side view of the circular ion trap mass spectrometer showing the exit apertures.

DETAILED DESCRIPTION OF THE PREFERRED EMBODIMENTS

Figure 1:
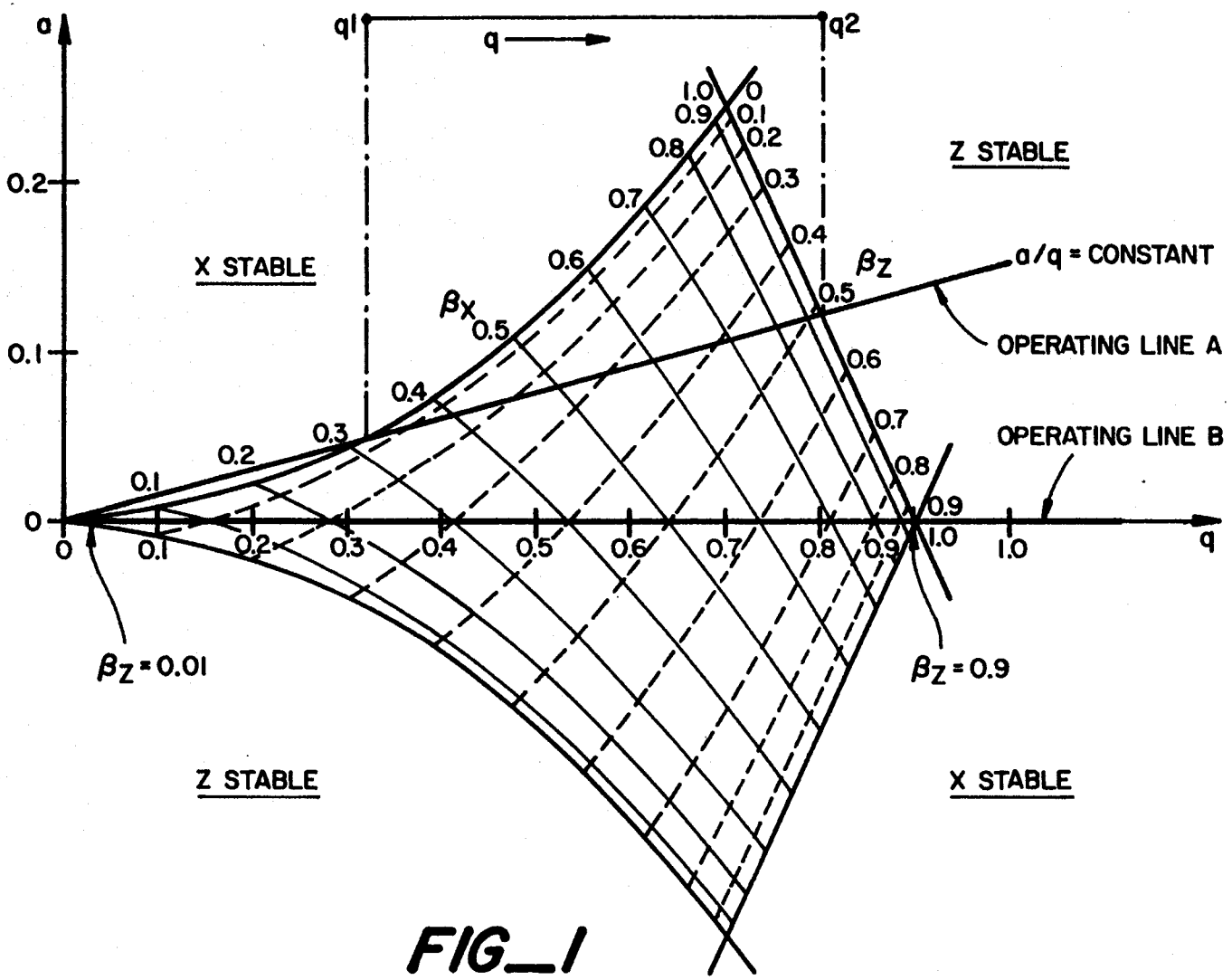
FIG. 1 is a stability diagram for a two-dimensional quadrupole ion trap mass spectrometer.

In discussing the advantages of the various embodiments of the present invention, the terms "enlarged" or "elongated" are used with respect to the ion occupied volume, and in some cases, the trapping chamber or electrode structure. The appropriate reference is the ion occupied volume of any ion trap. That is, the reference is a particular ion occupied volume and average charge density. To obtain the advantages of the present invention with any ion trap, one increases the ion occupied volume without any increase in the average charge density. As discussed herein, one way of increasing the ion occupied volume is to enlarge the trapping chamber or elongating the electrode structures in an axial (y-axis)

direction only. By creating an ion occupied volume that is larger than the previous ion occupied volume along with the various methods of mass analysis discussed herein, the benefits of the present invention will be realized.

The ion trap mass spectrometers disclosed herein are used with various well-known methods of mass analysis. Several different ion trap geometries can be used to increase the ion occupied volume of a substantially quadrupole ion trap mass spectrometer. Since the value of the average charge density ($\rho$), is limited by the effects of space charge, only the ion occupied volume v can be increased to increase the total number of ions (N) stored in an ion trap. However, simply increasing the volume of the trapping chamber does not necessarily increase the ion occupied volume. The volume of the trapping chamber must be increased only in the y-direction (axially) instead of in the x- or z-directions (radially). The following geometries with enlarged ion occupied volumes are described herein: the straight two-dimensional substantially quadrupole ion trap, the circular two-dimensional substantially quadrupole ion trap, the curved two-dimensional substantially quadrupole ion trap, and the ellipsoid three-dimensional ion trap. All other geometries that increase the ion occupied volume apply.

For example, let the number of ions in an ion trap (N) be defined by the equation $N=\rho v$, where $\rho$ is the average charge density and v is the ion occupied volume (not the trapping chamber) under gas damped conditions. Based on a simplified assumption that 95% of the ions are stored within a sphere with radius $r_{sphere}=0.7$-mm then the ion occupied volume for the purpose of this example is 1.4-mm$^3$ for a commercial Finnigan ion trap. If $\rho$ is limited by space charge to, for example, 10,000-ions/mm$^3$ (Fischer trapped krypton ions at densities of 2000–4000-ions/mm$^3$ in non-helium damped conditions. E. Fischer, 156 Z. Phys. 26 (1959)), an ion trap with this volume could store approximately 14,000 ions.

One embodiment of the present invention uses the apparatus in the mass-selective instability scan mode. DC and RF voltages, U and V cos $\omega t$, respectively, are applied to the electrode structure to form a substantially quadrupole field such that ions over the entire mass-to-charge (m/e) range of interest can be trapped within the substantially quadrupole field. The ions are either formed in or introduced into the trapping chamber of the ion trap mass spectrometer. After a brief storage period, the trapping parameters are changed so that trapped ions of increasing values of m/e become unstable. These unstable ions develop trajectories that exceed the boundaries of the trapping structure and leave the field through a perforation or series of perforations in the electrode structure. The ions then are collected in a detector and subsequently indicate to the user the mass spectrum of the ions that were trapped initially.

Figure 2A:
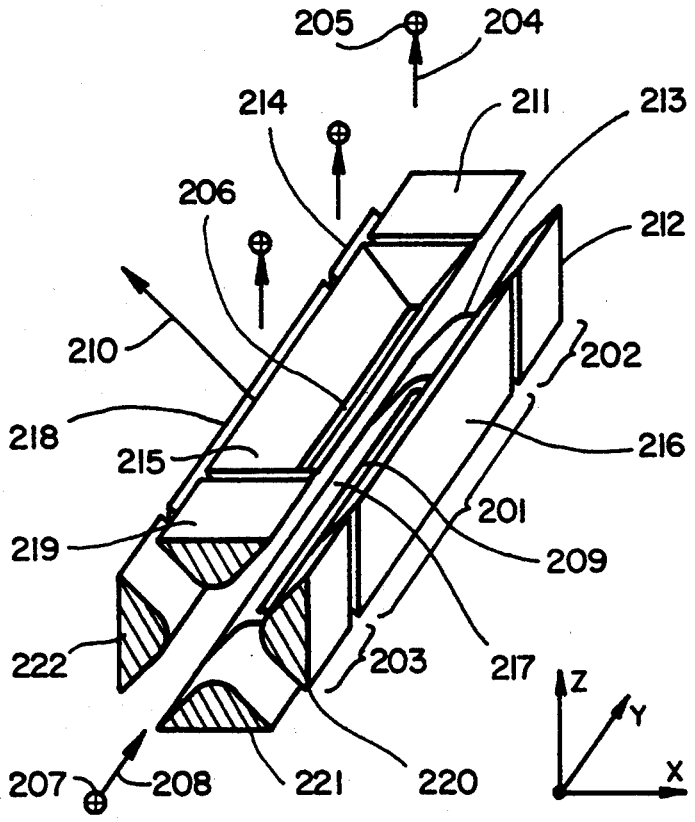
FIG. 2A is an isometric view of an embodiment of the present invention showing an enlarged two-dimensional substantially quadrupole ion trap mass spectrometer comprising a central section and two end sections that form a two-dimensional substantially quadrupole field.
Figure 2B:
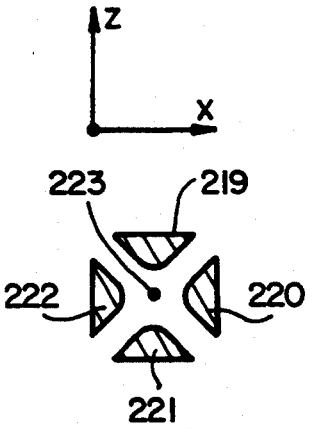
FIG. 2B is a front view of the entrance end of the embodiment of FIG. 2A.
Figure 2C:
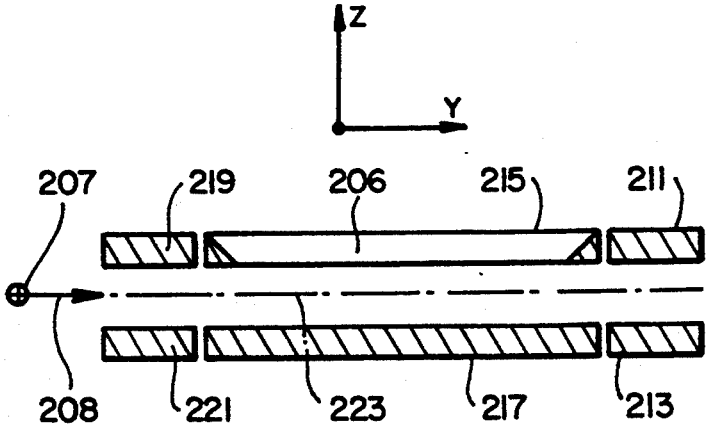
FIG. 2C is a cross sectional view of the embodiment of FIG. 2A.

Reference to the drawings will clarify the use of the apparatus of the present invention with the mass-selective instability scan mode. One embodiment of the present invention is shown in FIGS. 2A, 2B, and 2C. A two-dimensional substantially quadrupole ion trap mass spectrometer is shown with three sections: a central section 201, and two end sections 202 and 203. Each section includes two pairs of opposing electrodes. For rear end section 202, z-axis electrodes 211 and 213 are positioned and spaced opposite each other; x-axis electrodes 212 and 214 are positioned and spaced opposite each other. Entrance end section 203 has z-axis opposing electrodes 219 and 221, and x-axis electrodes 220 and 222. Central section 201 has z-axis opposing electrodes 215 and 217, and x-axis electrodes 216 and 218. The combination of these sections creates an elongated and enlarged trapping chamber for trapping ions in an enlarged volume of space. The end sections can also be plates, one of which has an aperture, with the appropriate voltages to keep the ions trapped in the central section.

Every geometry disclosed herein has a center axis. The center axis is the line located substantially along the center of the ion occupied volume. This usually coincides with a similar line along the center of the trapping chamber. In FIG. 2B, which is a front view (from the ion entrance end) of the ion trap of FIG. 2A, the center axis 223 is represented as a point in the center of the ion occupied volume. The point is in effect a line lying perpendicular to the x-z axes. In FIG. 2C, a cross sectional view of the same embodiment clearly shows the center axis 223 running along the center of the enlarged ion occupied volume. Usually, the center axis 223 is the locus of points equidistant from the apices of opposing electrodes.

In FIG. 2A, the total ion occupied volume ($v=\pi r^2 l$), as opposed to the larger volume of the trapping chamber, is calculated as approximately 154-mm$^3$ assuming the ion occupied volume is modeled as a cylinder of radius $r=0.7$ mm and length $l=100$ mm. This volume of ions could potentially store $1.5\times10^6$ ions which is a factor of 110 times greater than the more typical three-dimensional ion trap. The increase in volume allows the trapping of more ions at the same charge density without a corresponding increase in space charge. Trapping more ions improves the signal-to-noise ratio, sensitivity, and dynamic range. The increase in volume without an increase in the device size $r_0$ and frequency $\omega$ permits the use of the existing power supplies and reasonable applied voltages.

In FIG. 2A, entrance end section 203 can be used to gate ions 207 in the direction of the arrow 208 into the ion trap mass spectrometer. The two end sections 202 and 203 differ in potential from the central section 201 such that a "potential well" is formed in the central section 201 to trap the ions. Elongated apertures 206 and 209 in the electrode structures allow the trapped ions to be mass-selectively ejected (in the mass selective instability scan mode) in the direction of arrow 204, a direction orthogonal to the center axis 223. Those ions 205 that have been rendered unstable leave the trapping chamber in a direction substantially parallel to the x-z plane through this elongated aperture. This elongated aperture lies linearly in the y-z plane. Alternatively one could eject ions between the electrodes of the ion trap mass spectrometers in the direction indicated by arrow 210 by applying phase synchronized resonance ejection fields to both pairs of rods at, for example, $\beta_x=0.3$, $\beta_z=0.3$. An aperture in the electrode structures would not be required in this case, although an exit lens is recommended. These ions are then sent to a detector. Although not shown in FIGS. 2A, 2B, and 2C, a shield or exit lens is placed before the detector for optimum performance.

Figure 3:
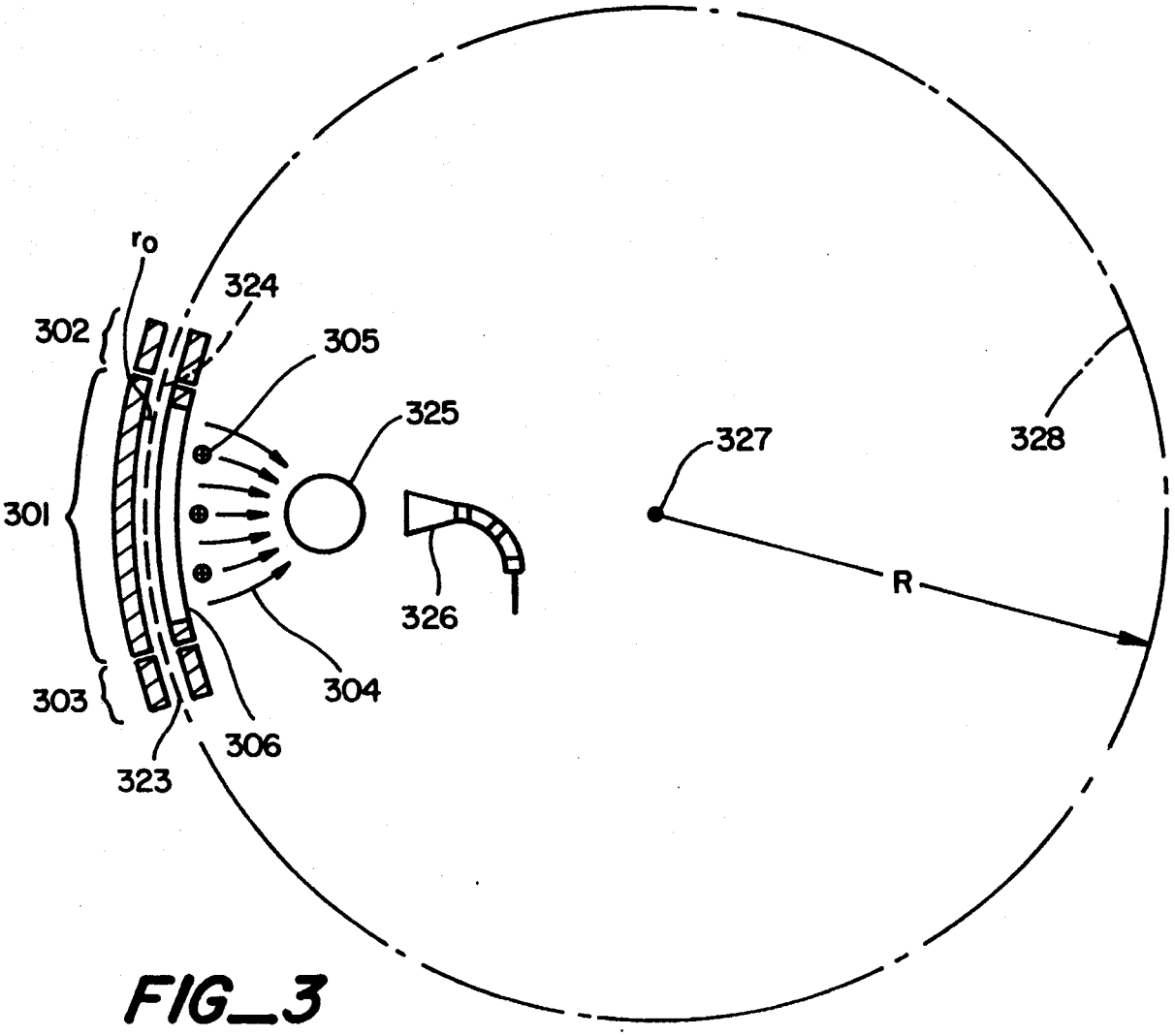
FIG. 3 is a diagram of an alternative embodiment of the present invention comprising an enlarged curved two-dimensional substantially quadrupole ion trap mass spectrometer.

FIG. 3 shows another embodiment of the present invention. This curved ion trap mass spectrometer also has three sections, a central section 301 and two end sections 302 and 303. The center axis 323 is shown located along the center of the trapping chamber. Ejected ions 305 leave the ion trap mass spectrometer through the elongated aperture 306 in the direction of the arrow 304, a direction orthogonal to the center axis 323. These ions strike a dynode 325 which yields secondary particles that transit to a detector 326. The detector 326 should be directed toward the face of the dynode 325, which determines the direction of secondary particle emissions. Further processing of the ion signal is provided by a data system and is done by a well-known means of providing an output signal indicative of the masses of the ions and the number of ions.

In some cases, the shape and curvature of the elongated aperture depends on the shape and curvature of the enlarged electrode structure. In FIG. 2A, the two-dimensional ion trap mass spectrometer has a straight elongated aperture in the electrode structures because the ion trap mass spectrometer has a straight shape. If the enlarged structure is curved, the elongated apertures should be curved likewise.

Several of the ion trap mass spectrometer geometries will have field faults. Geometries that could be used to increase the ion occupied volume must take into consideration the effects of field faults. Field faults are caused by higher order multipole fields which may lead to short storage times of ions due to the excitation/ejection of ions at the multipole (non-linear) resonance lines in the stability diagram.

The effect of field faults decreases as the ratio $R/r_0$ increases. R is the radius of the curvature of the overall enlarged structure and $r_0$ is related to the device size. As shown in FIG. 3, $r_0$ is the distance from the center of the substantially quadrupole field (usually the center axis 323) within the electrode structure to the apex of the electrode surface. R is the radius of the "best fit circle" 328 with center 327 that fits the curvature of the ion trap mass spectrometer where the portion of the perimeter line of the "best fit circle" that overlaps the ion trap mass spectrometer is the locus of points 324 constituting the center of the trapping chamber, or in effect, the center axis 323.

The straight two-dimensional substantially quadrupole ion trap obviously does not have field faults due to curvature. The curved and circular ion traps shown in FIGS. 3 and 4, respectively, have field faults due to the curvature of these ion traps. The greater the degree of curvature the greater the effect of higher order multipole fields. In FIG. 4, $R/r_0=3$ ($R=30$ mm and $r_0=10$ mm) for the circular substantially quadrupole ion trap and thus it would have a relatively large contribution due to higher order multipole fields. For this reason the curved ion trap is shown with a radius $R=20$-cm and $r_0=4$-mm ($R/r_0=50$). The large radius would keep the field faults small, given the small $r_0$, and the device could still be placed into a reasonably sized vacuum chamber. $R/r_0=\infty$ for the straight two-dimensional ion trap mass spectrometers. Cutting apertures or slots lengthwise into two opposing rods in the two-dimensional substantially quadrupole ion trap (see FIG. 1) for ion ejection using resonance ejection will also cause field faults. In addition the use of round rod quadrupoles will produce sixth-order distortions.

Damping gas, such as helium (He) or hydrogen ($H_2$), at pressures near $1\times10^{-3}$ torr, reduces the effects of these field faults because of collisional cooling of the ions. In general, the overall trapping and storage efficiency of these ion trap mass spectrometers filled with helium or hydrogen will be increased due to collisional cooling while trapping the ions.

Figure 4A:
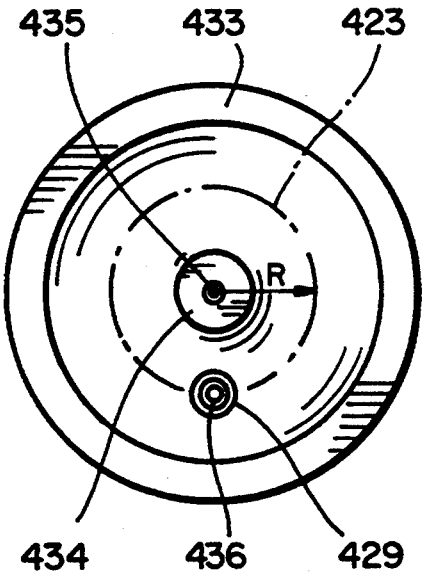
Figure 4C:
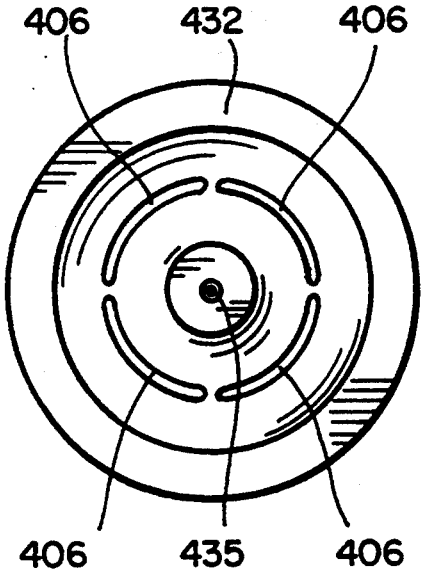
Figure 4B:
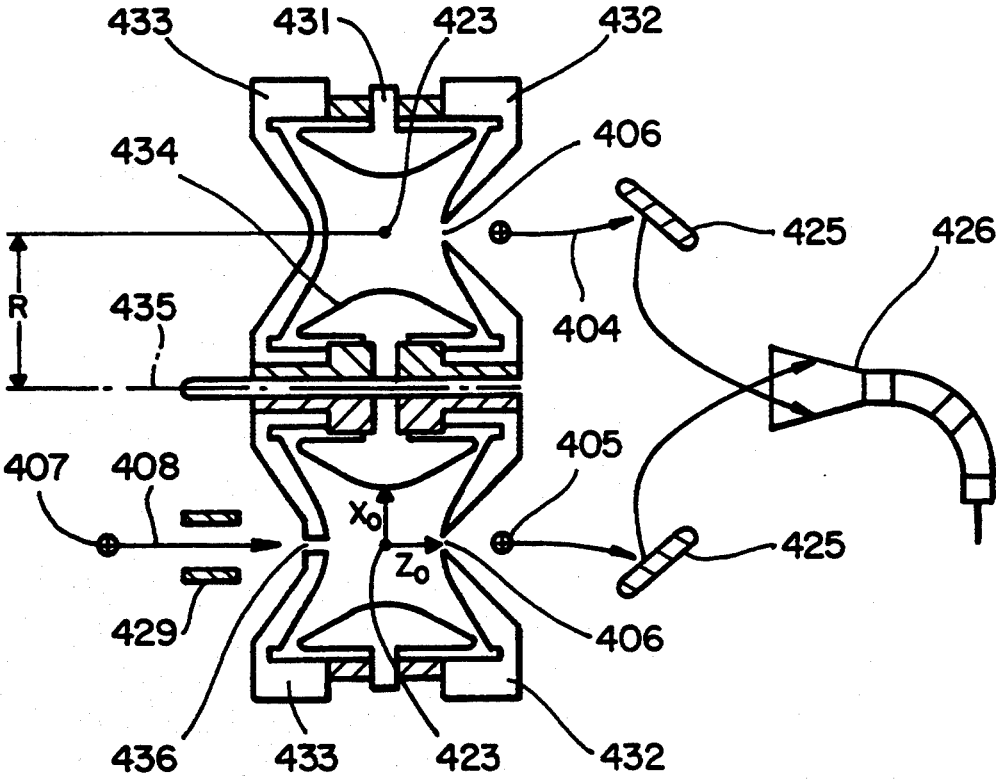

In FIGS. 4A, 4B, and 4C, a third embodiment of the present invention is shown. FIG. 4B is a cross-section of the circular ion trap mass spectrometer in a plane through the center of the circular ion trap mass spectrometer and normal to the circular faces of the ion trap mass spectrometer. The ion trap mass spectrometer is circular in shape along the center axis 423 and the ion occupied volume. The substantially quadrupole field is two-dimensional. In effect, one end of the ion trap mass spectrometer of FIG. 2A (without the end sections) or FIG. 3 is joined or connected to the other end of the ion trap mass spectrometer to form a circular trapping chamber.

Figure 9A:
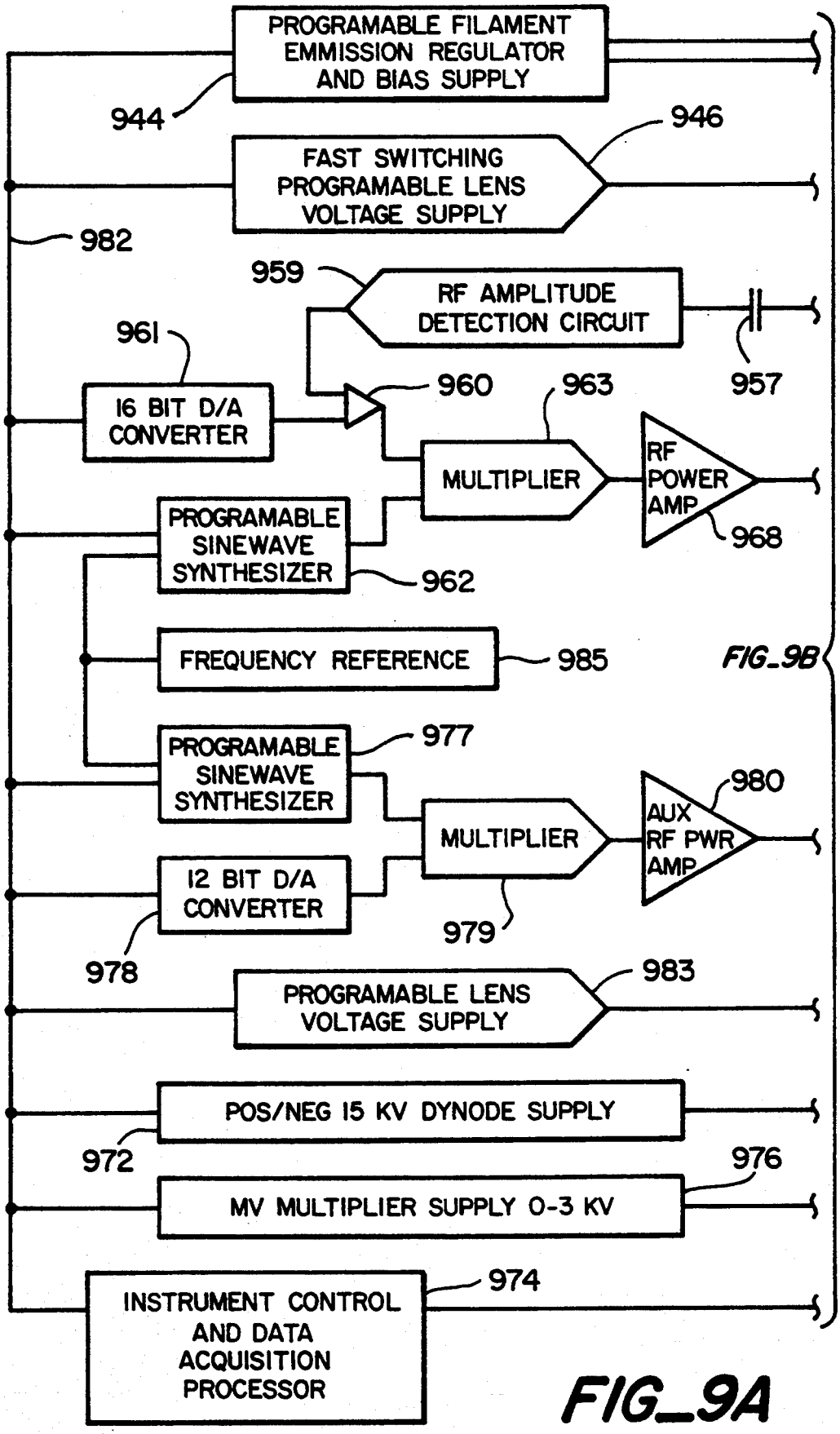
FIG. 9 shows a circuit diagram for operating another embodiment of the circular two-dimensional ion trap mass spectrometer of FIGS. 4A, 4B, and 4C.
Figures 9A, 9B:
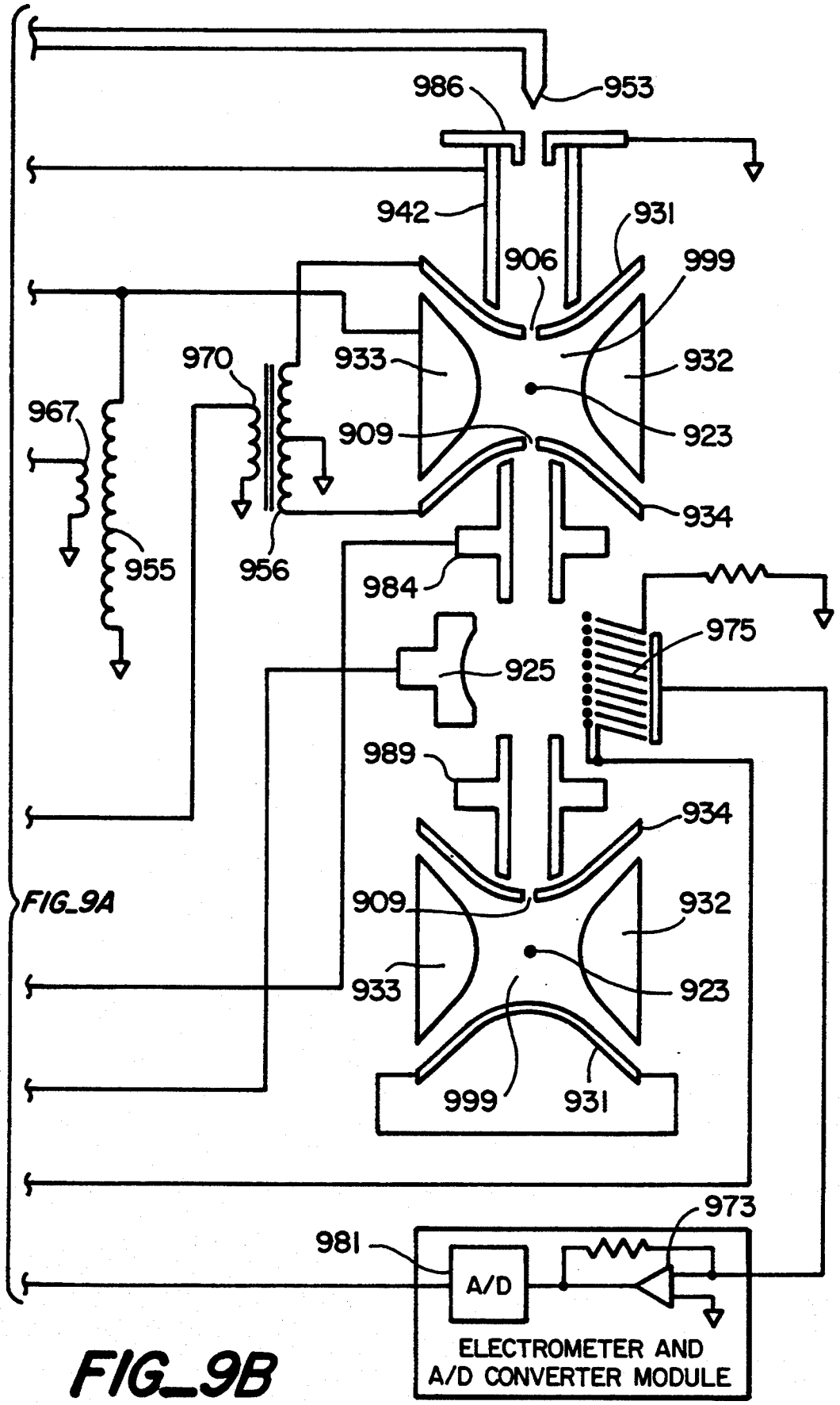

If R is increased and/or $r_0$ is decreased, the effects of field faults could be minimized. If a circular ion trap is used with a radius $R=30$-mm the total ion occupied volume ($v=\pi r^2(2R\pi)$) is 290mm$^3$. This volume could potentially store $2.9\times10^6$ ions which is a factor of 207 times greater than the more typical three-dimensional substantially quadrupole ion trap. Small R will require the detector to be placed as shown in FIG. 4. However, larger R will allow placement at the center of the device as shown in FIG. 9.

Since the ion trap mass spectrometer is substantially circular along the elongated electrode structure, the curvature R is essentially the distance from the center 435 of the structure to the center axis 423 within the electrode structure. The entire ion trap mass spectrometer is constructed of four electrodes: ring electrode 431 forming the outer ring of the trapping chamber, ring electrode 434 forming the inner ring of the trapping chamber, and end electrodes 432 and 433 located opposite each other along the circular plane formed by the substantially concentric ring electrodes. Center axis 423 is shown as two points in the ting-like ion occupied volume; however, it is a circle located on the center of the enlarged ion occupied volume.

Ions 407 enter the circular trapping chamber at one end electrode 433. Another way is through the outer ring electrode 431 given a proper aperture. These ions 407 are gated or focused by focusing lens 429. After some storage interval, the ions are mass-selectively ejected through an elongated aperture 406 through a direction orthogonal to the center axis 423 indicated by arrow 404. Alternatively, the ions may be resonantly ejected in the x-direction as shown later in FIG. 9. In other embodiments of the present invention, more than one aperture is provided as shown in FIG. 2A by apertures 206 and 209. This geometry, as with the others, may use various methods of mass analysis. In particular, the mass-selective instability scan with or without a supplemental resonance field is used with this apparatus.

FIGS. 4A and 4C show the side views of this circular ion trap mass spectrometer. Here, the circular shapes of end electrodes 433, 432, as well as the center axis 423 in the enlarged ion occupied volume are displayed. The trapping chamber volume is the space housed within the ring and end electrodes. Focusing lens 429 and entrance aperture 436 are also shown. The presence of a particular voltage on the focusing lens 429 directs ions into the trapping chamber through aperture 436. The shape and relative size of the exit apertures 406 are also displayed. The elongated apertures 306 (in FIG. 3) and 406 (in FIG. 4) are curved like the electrode structures.

The ejected ions strike a dynode 425 where secondary particles are emitted to a detector 426. The placement and type of detector used for these large storage volume ion trap mass spectrometers are also important to detect all of the ions. For some geometries, a microchannel plate detector with an appropriate dynode may be optimum. This is because ions ejected from the two-dimensional substantially quadrupole device would be resonantly ejected orthogonally along the entire length of the two opposite z-poles. In other geometries a single electron multiplier is sufficient. For example, the curved non-linear substantially quadrupole ion trap mass spectrometer of FIG. 3 requires a single dynode and electron multiplier. The circular ion trap mass spectrometer of FIG. 4 shows a single dynode and channel electron multiplier after the exit end cap. Alternatively, this detector could be placed at the assembly center (see FIG. 9), similar to the placement in the curved ion trap of FIG. 3.

Figure 5A:
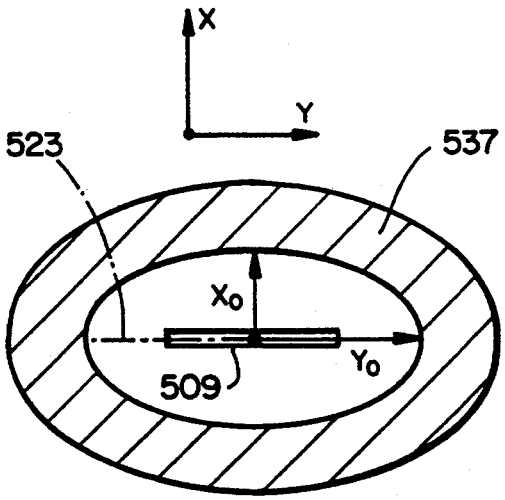
FIG. 5A is a cross-section (x-y plane) of a fourth embodiment of the present invention comprising an enlarged elliptical three-dimensional ion trap mass spectrometer with enlarged ion occupied volume. Only the ring electrode with exit end cap and aperture is shown.
Figure 5B:
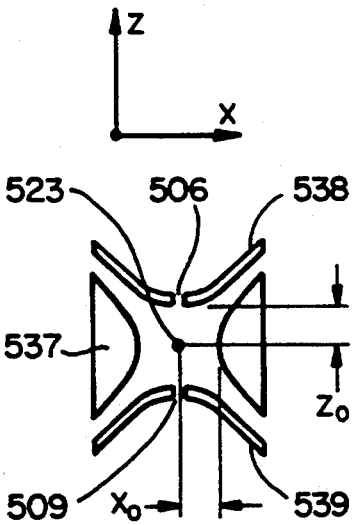
FIG. 5B is a cross section (x-z plane) of the elliptical three-dimensional ion trap mass spectrometer.
Figure 5C:
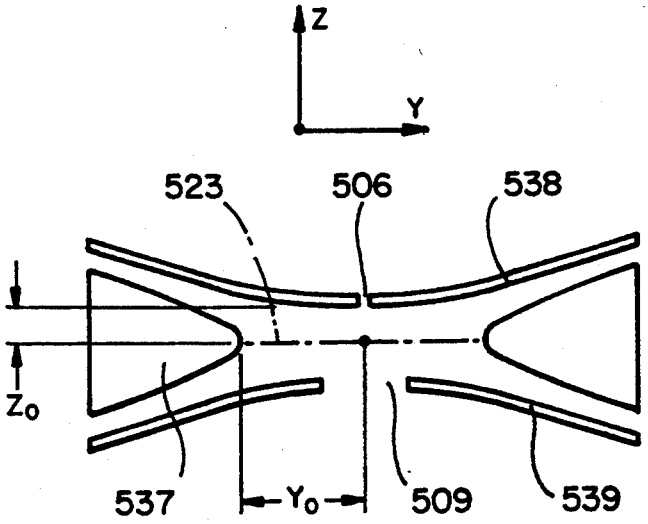
FIG. 5C is a cross section (y-z) plane of the elliptical three-dimensional ion trap mass spectrometer.

FIGS. 5A, 5B, and 5C show another embodiment of the present invention—a three-dimensional elliptical ion trap mass spectrometer. FIG. 5A shows a cross sectional view (along the x-y plane) of a three-dimensional ion trap mass spectrometer such as a three electrode ion trap, along with a relative location of the aperture 509. All three electrodes 537, 538, and 539 have an elliptical shape. The aperture 506 is located in the ion entrance electrode in a position similar to that shown in FIG. 5A. The shortest distance from the center of the ion trap to the apex of the ring electrode 537 is $x_0$. The longest distance from the center of the ion trap to the apex of the ring electrode 537 is $y_0$. The center axis 523 is along the enlarged ion occupied volume in the direction of the y-axis.

FIG. 5B is a x-z-plane cross-section schematic of the elliptical ion trap. The center axis 523 is an imaginary line lying normal to the page at the point shown. $z_0$ is the shortest distance from the center of the ion trap to the apex of one of the end electrodes 538, 539 or, if an aperture has been formed where the apex would have been, an imaginary surface forming the apex of the end electrode had the aperture not been formed. $x_0$ is as defined earlier for FIG. 5A. In one embodiment, ions enter through aperture 506 and exit through aperture 509.

Finally, FIG. 5C shows a side view (along the y-z plane) of the elliptical ion trap. Along with FIG. 5A, FIG. 5C shows the enlarged ion occupied volume located about the center axis 523. In one embodiment of the present inventive mass analysis method, stable ions are ejected from the ion trap through aperture 509 by the mass selective instability scan method. Possible values of $z_0$, $x_0$, and $Y_0$ for this elliptical ion trap are 1.000 cm, 1.020 cm, and 5.990 cm, respectively. However, other values for the dimensions can be used.

Figure 6:
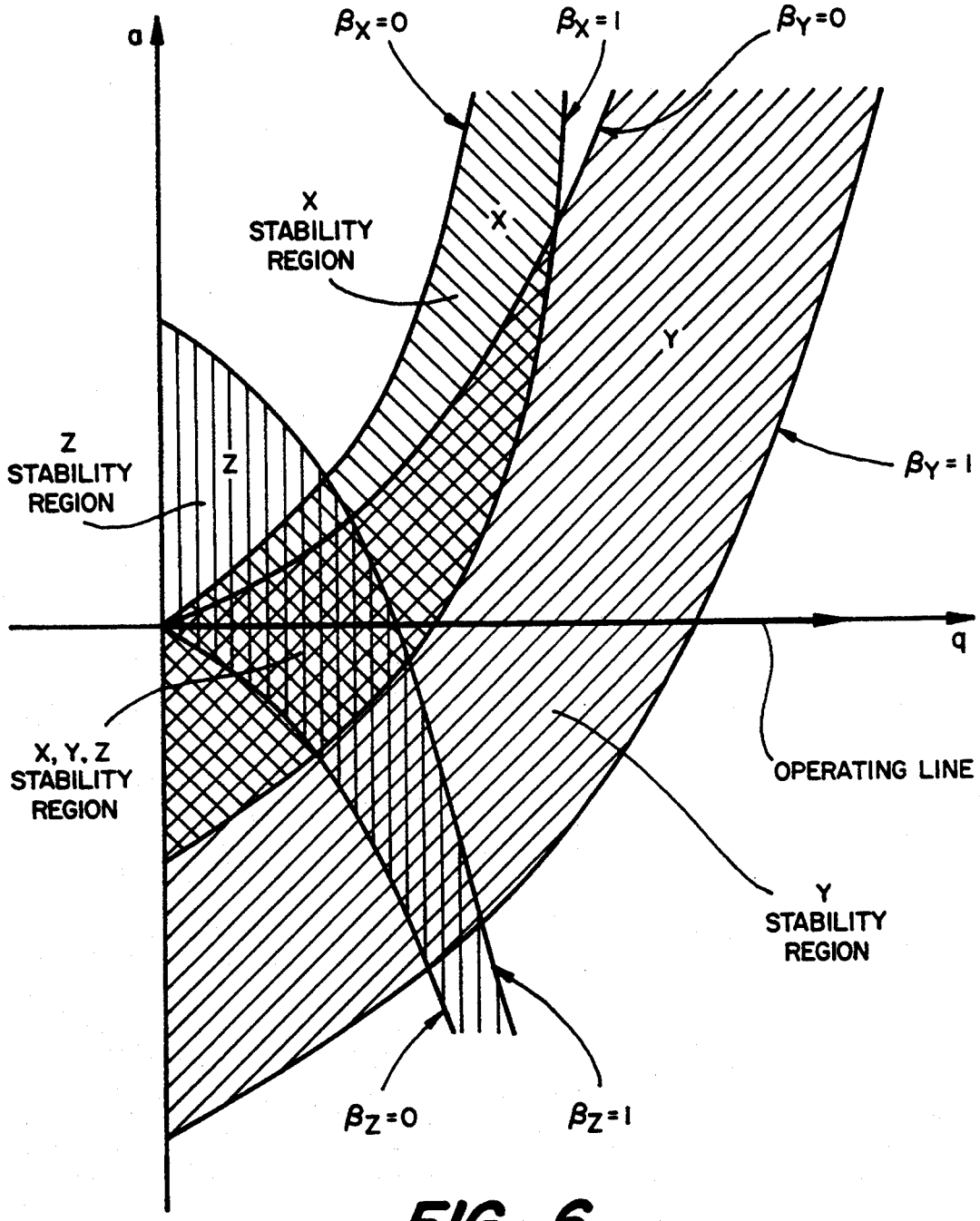
FIG. 6 shows a stability diagram of a three-dimensional elliptical ion trap mass spectrometer.

The ion trap of FIGS. 5A, 5B, and 5C would have a unique stability region comprising the area of intersection of three stable regions, x, y, and z. An ion would have to be located in the area of intersection of all three regions to be stable in all three dimensions. FIG. 6 shows a stability diagram for a three-dimensional elliptical ion trap mass spectrometer. Ions with $a_u$, $q_u$ coordinates in the shaded region of stability are trapped. One possible operating line at $a_u=0$ is also shown in FIG. 6.

Figure 7A:
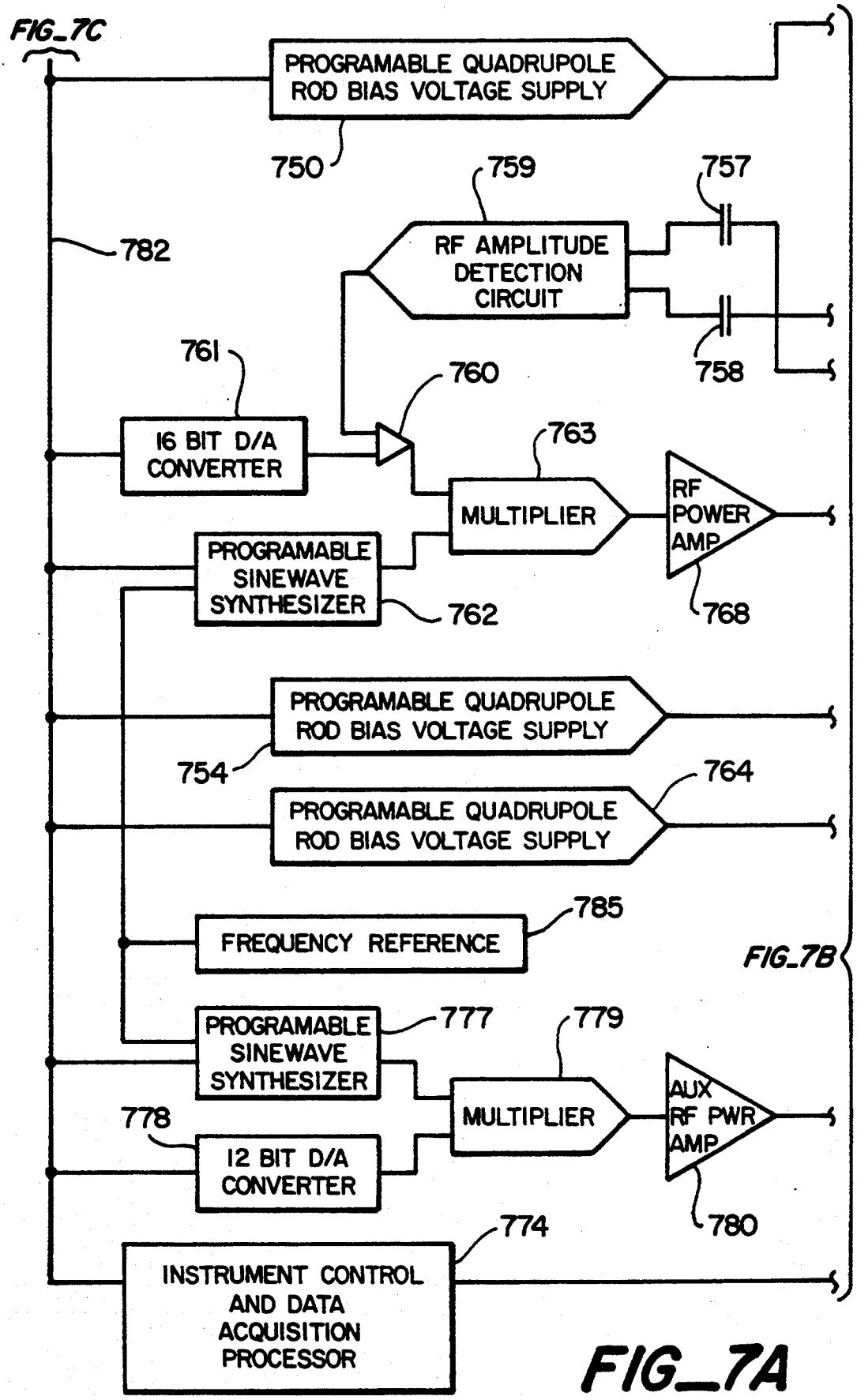
FIG. 7 shows a circuit diagram for operating the enlarged and straight two-dimensional ion trap mass spectrometer of FIGS. 2A, 2B, and 2C.
Figure 7B:
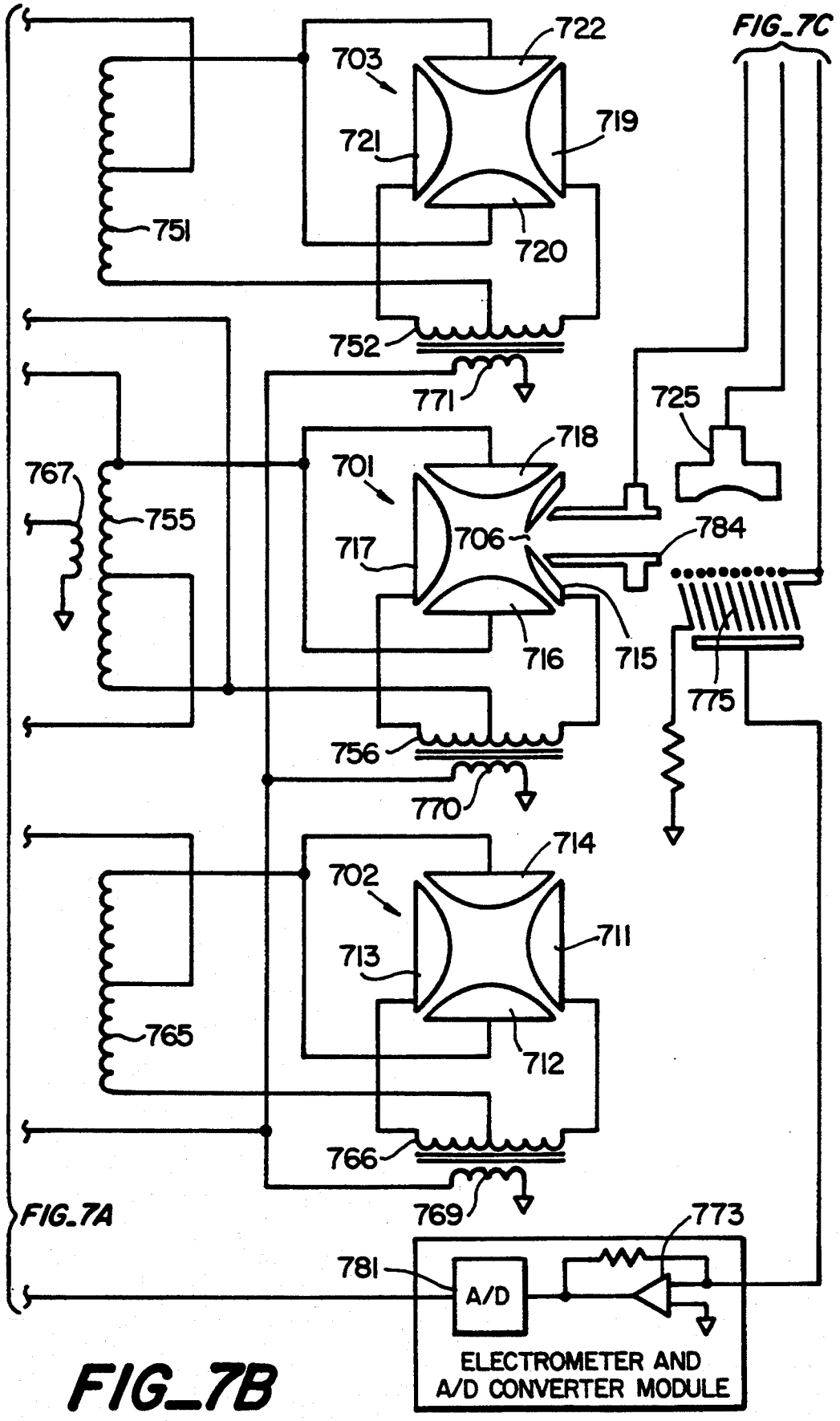
Figure 7C:
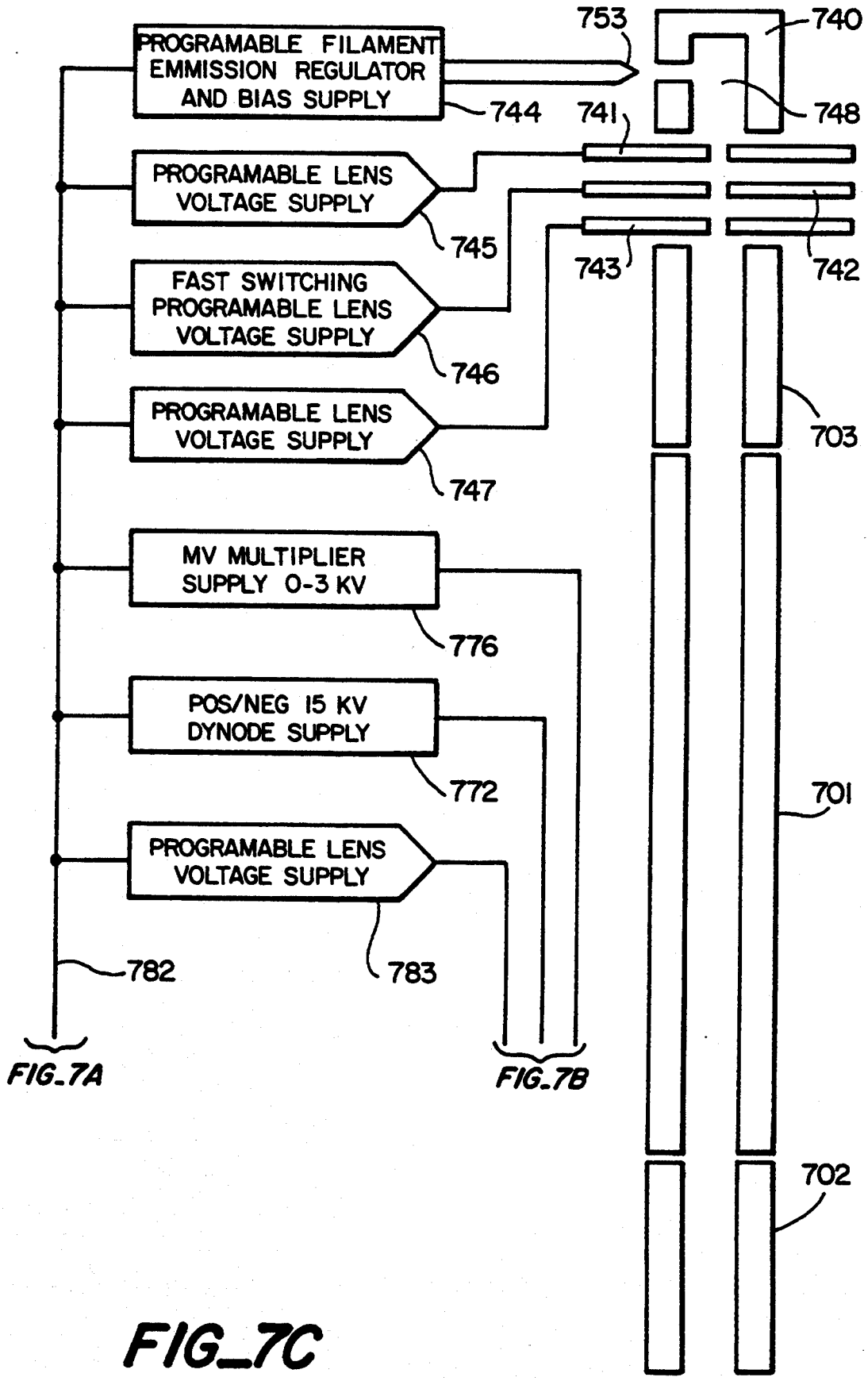

FIG. 7 shows a circuit diagram for operation of the straight two-dimensional substantially quadrupole ion trap mass spectrometer of FIG. 2A. The ion trap mass spectrometer has three sections—one central section 701 and two end sections 702 and 703. Gas molecules in an ion source 740 are ionized by an electron beam emitted from a filament 753 controlled by a programmable filament emission regulator and bias supply 744. Ions are continuously created in an ion volume 748 of the ion source 740. In order to gate or introduce ions into the ion trap mass spectrometer, a focusing lens system comprising lens 741, 742, and 743 is placed between the ion source 740 and the ion trap mass spectrometer's entrance end section 703. Various well-known methods exist to gate the ions into the ion trap mass spectrometer. Essentially, differential voltages among the lens 741, 742, and 743 set up by programmable lens voltage supplies 745, 746, and 747, respectively dictate when and how many ions are gated into the ion trap mass spectrometer. Entrance end section 703 can also be used to gate ions into the ion trap mass spectrometer. An instrument control and data acquisition processor 774 sends addressed control signals to the fast switching programmable lens voltage supply 746 via a digital instrument control bus 782 to gate ions into the ion trap mass spectrometer for a predetermined period of time (e.g., 100 ms). Because of a proportional relationship between gating time and amount of ions gated, the latter is determined by controlling the former.

Programmable quadrupole rod bias voltage supplies 750, 754, and 764 provide a differential DC voltage to the electrodes of entrance end section 703, central section 701, and rear end section 702, respectively. These DC voltages are applied to each pair of opposing electrodes via identical center tapped transformers 751 and 752 for entrance end section 703, transformers 755 and 756 for central section 701, and transformers 765 and 766 for rear end section 702. To trap positive ions in the central section of the ion trap mass spectrometer, the DC quadrupole offset of the central section 701 is biased to a small negative voltage relative to the ion source 740 and the quadrupole offsets of the end sections 702 and 703 by programmable quadrupole rod bias voltage supply 754. This creates the desired axial (y-axis) DC potential well.

Frequency reference 785 is provided to serve as a common time standard for sinewave synthesizers 762 and 777 used to generate the substantially quadrupole field frequency f and the auxiliary, or supplemental, field frequency $f_{res}$, respectively. Control of the amplitude portion (V) of the sinusoidal RF voltage applied to the electrode pairs is provided by the 16-bit digital-to-analog converter 761 which is addressed and written to by the instrument control and data acquisition processor 774. The analog voltage output by this digital-to-analog converter is the control signal for a feedback control system that regulates the amplitude of the RF voltage, V. The elements of this feedback loop are the high gain error amplifier 760, the analog multiplier 763, the RF power amplifier 768, the primary winding 767 and the three center-tapped tri-filar secondary windings 751, 755, 765 of the resonant RF transformer, RF detector capacitors 757, 758 and RF amplitude detection circuit 759.

If the end sections are relatively long compared to the $r_0$ of the structure, and the gaps between the structures are very small, the integrity of the RF component of the substantially quadrupole field will be very good throughout the length of the central section 701 of the ion trap mass spectrometer, where ions are trapped, including the regions adjacent to the gaps between sections.

The method of mass selective instability operation will now be discussed in conjunction with the circuit diagram of FIG. 7. In FIG. 1, lines A and B represent two scan, or operating, lines. Operating line A represents the mass selective stability mode of operation where the ratio a/q is constant. This is the operating line for a transmission quadrupole mass filter. No ion trapping is attempted by this method. Operating line B represents the mass selective instability mode of operation with $a_u=0$. Here, the ions are first trapped and then scanned off the, for example, $q=0.908$, $\beta_x=1.0$, $\beta_z=1.0$ edges of the stability diagram. This mode of operation renders ions unstable in both the x and z directions. The value of the RF amplitude provided by the instrument control and data acquisition processor 774 which is converted into analog form by a 16-bit digital-to-analog converter 761 may be varied to coincide with the operating line B of FIG. 1. Alternatively, a small differential DC voltage can be applied to the electrodes to all three sections along with the RF voltage.

Ejected ions leave the trapping chamber through aperture 706. The exit element 784 directs the ejected ions toward dynode 725. The programmable lens voltage supply 783 sets up the appropriate voltage level to the exit element 784. The dynode 725 generates secondary emissions of particles to be collected by a multichannel electron multiplier 775. The dynode 725 is powered by a power supply 772 (±15 kV is not uncommon) and the multichannel electron multiplier 775 is powered by a high voltage power supply (−3 kV is not uncommon) 776.

At the output of the multichannel electron multiplier 775 is an ion current signal whose magnitude is representative of the number of ions detected of a particular m/e. This ion current is converted into a voltage signal by electrometer 773. The resulting voltage signal is converted into digital form by analog-to-digital converter 781. The digital signal, representative of the masses of the detected ions, is then entered into the instrument control and data acquisition processor 774.

For application of the supplemental resonance excitation ejection waveform, which is the preferred method of mass analysis, an auxiliary AC voltage is provided to the pair of opposite rods consisting of the exit aperture. The instrument control and data acquisition processor 774 provides an addressed AC amplitude value to a 12-bit digital-to-analog converter 778. A programmable sinewave synthesizer 777 uses the frequency reference 785 to generate a sinusoidal signal with a frequency $f_{res}$. The AC amplitude and the sinusoidal signal are multiplied in multiplier 779 to generate an auxiliary AC voltage which is then amplified by an auxiliary power amplifier 780. This resonance ejection AC voltage is applied to the electrodes via transformers 769, 770, and 771. By applying a resonance ejection potential to the pair of electrodes in the z-direction at, for example, $\beta_z=0.85$ (see FIG. 1), ions can be ejected in just the y-z plane (see FIG. 2).

Figure 8A:
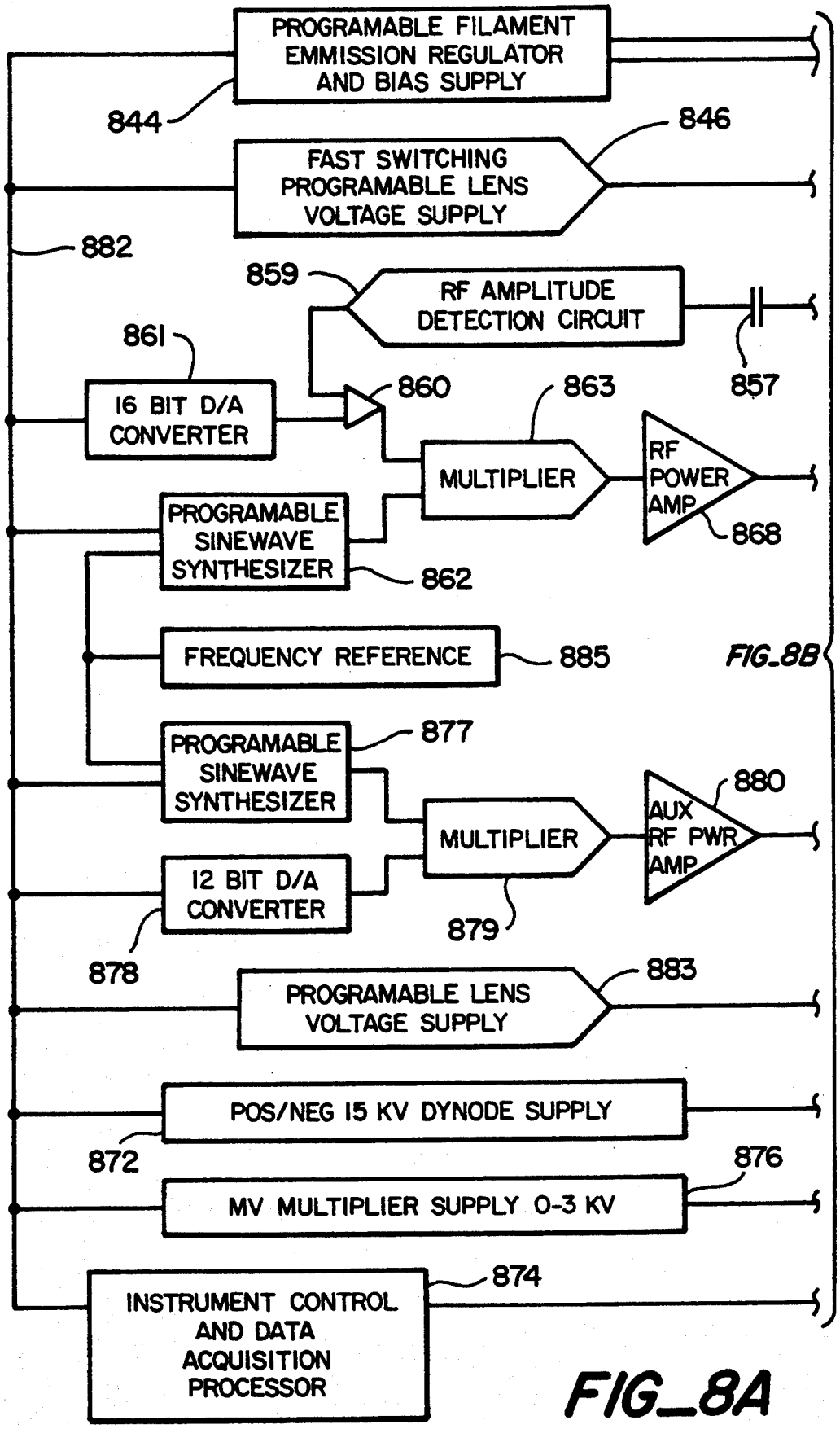
FIG. 8 shows a circuit diagram for operating the elliptical three-dimensional ion trap mass spectrometer of FIGS. 5A, 5B, and 5C.
Figures 8A, 8B:
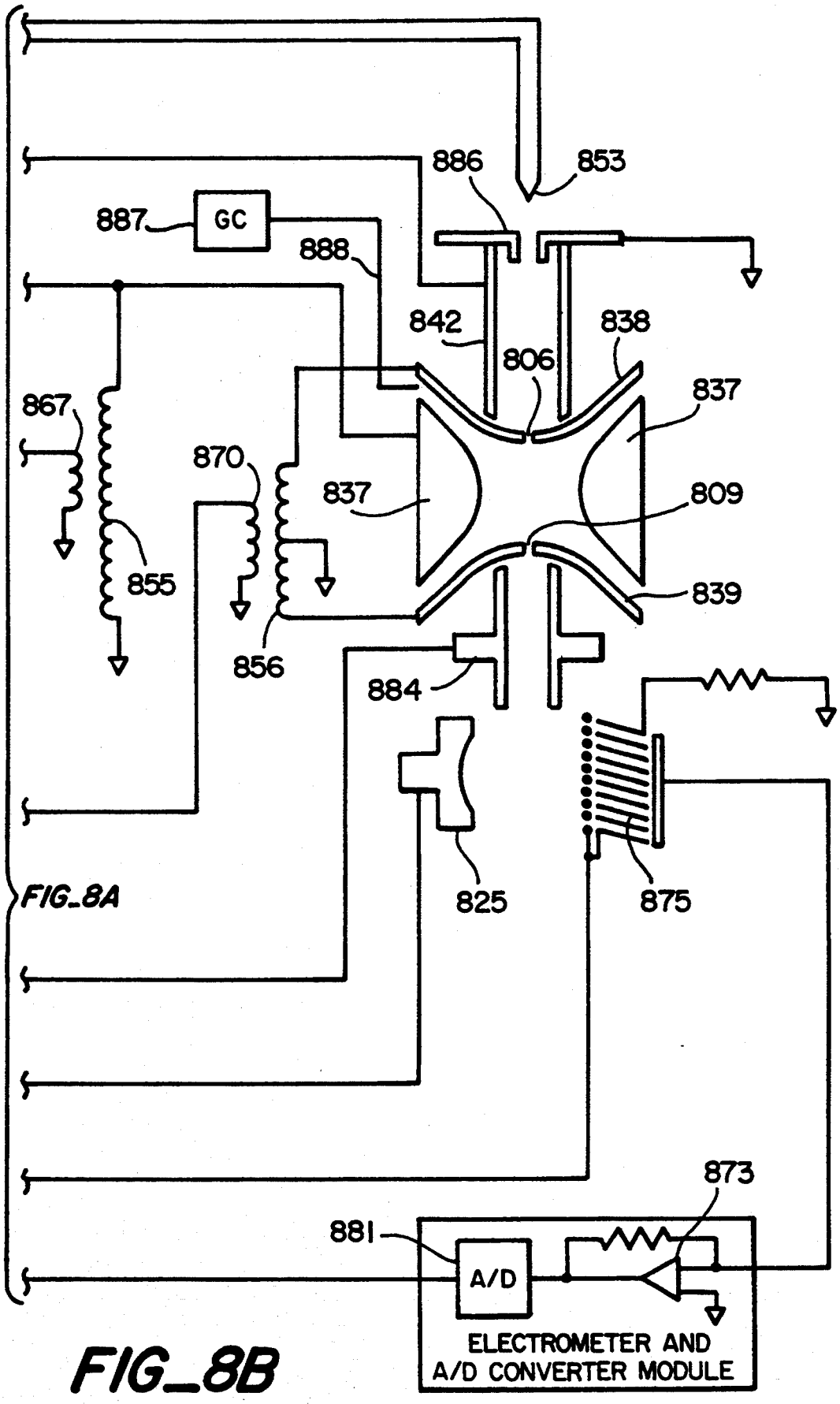

In another embodiment of the present invention, as shown in FIG. 5A, 5B, and 5C, the ion trap mass spectrometer is a three-dimensional ion trap formed from one elliptical ring electrode (when viewed from above in the x-y plane) and two end electrodes (also ellipsoid-shaped in the x-y plane). One embodiment of the circuit implementation for the elliptical ion trap mass spectrometer system is shown in FIG. 8. In FIG. 8, many of the circuit elements are common to that of FIG. 7, offset by 100 (that is, RF power amplifier 768 of FIG. 7 performs in the same manner and is equivalent to RF power amplifier 868 in FIG. 8).

A x-z plane cross section of the three-dimensional elliptical ion trap is shown in FIG. 8. In this particular embodiment, internal ionization is employed to form ions inside the trapping chamber defined by and enclosed within the electrode walls. Samples from, for example, a gas chromatograph (GC) 887 are introduced into the trapping chamber through GC line 888. The filament 853, controlled by the filament emission regulator and bias supply 844, bombard the sample gas molecules with electrons to form ions. Electrons are gated into the ion trapping chamber through entrance aperture 806 through aperture plate 886 and electron gate 842. When the ions are trapped in the ion trap mass spectrometer's trapping chamber, many scan methods can be employed for mass analysis. For example, the fundamental RF voltage, V, can be scanned while applying the auxiliary remnant AC field with frequency $f_{res}$ across the end electrodes 838 and 839. The ejected ions leave the trapping chamber through exit aperture 809 and are directed through the exit lens 884 onto a dynode 825. Secondary particles are accelerated from the dynode 825 into the multichannel electron multiplier 875.

This three-dimensional elliptical ion trap of FIG. 8 and FIGS. 5A–5C provides an advantage over the conventional three-dimensional ion trap. In a conventional three-dimensional ion trap, increasing the volume of the trapping chamber by increasing $r_0$ results in a decrease in the mass range. Additionally, the cloud of ions formed in the center of the trapping chamber would have the same size and shape. This larger trapping chamber will not result in a corresponding improvement in the performance of the ion trap with respect to its tolerance to the effects from space charge. In contrast, the elliptical ion trap of one embodiment of the present invention, traps more ions by enlarging, only in the y-direction, the volume occupied by the cloud of ions (ion occupied volume) in the trapping chamber. By enlarging the ion occupied volume in this manner, more ions can be trapped without a decrease in the mass range.

FIG. 9 shows a circuit diagram of one embodiment of the present invention, a circular two-dimensional ion trap. In most respects, the major circuit components behave as described for the previous circuit diagrams of FIGS. 7 (offset by 200 in FIG. 9) and 8 (offset by 100 in FIG. 9); that is, for example, RF power amplifier 968 is equivalent to RF power amplifiers 768 (FIG. 7) and 868 (FIG. 8). Here, the trapping chamber 999 is circular. Four ring electrodes 933, 932, 931, 934 form the walls of the trapping chamber 999. An electron beam enters entrance aperture 906 to form ions internally in the trapping chamber 999. Ejection occurs through exit aperture 909 where ion exit lens 984 facilitate the ejected ions to travel toward the conversion dynode 925. In contrast to the circular ion trap of FIGS. 4A–4C, the detection means is located at the center of the circular ion trap device; that is, the detections means is located within the circle formed by ring electrode 934. Here, ions are ejected in a direction substantially parallel to the x-z plane (that is, orthogonal to the center axis 923).

In all of these embodiments, negative effects from space charge have not increased. The y-axis enlarged structure allows more ions to be introduced into the ion trap mass spectrometer while maintaining the same charge density. As a result, a greater number of ions may be trapped with space charge density remaining constant. An increased number of ions improves the performance by increasing the signal to noise ratio. Since more signal is present, sensitivity and detection limits will also improve. In addition to these improvements under normal scanning speeds of 180 μs/amu, the scanning speed can be reduced and the resonance ejection amplitude adjusted to improve resolution. See U.S. Pat. Nos. 4,736,101 and Re. 34,000. Higher resolution, however, has the disadvantage that the number of ions trapped must be reduced because the ions are more sensitive to the effects of space charge. By lowering the charge density in an ion trap with greater ion occupied volume, a high enough number of ions (N) in the ion trap can still be maintained for good signal-to-noise under high resolution scanning conditions. Furthermore, increasing the number of ions added $N_{add}$ results in a corresponding improvement in the dynamic range. High resolution scan modes typically suffer from broad mass peaks due to slow scan rates. Fewer ions must be trapped and analyzed because slow high resolution scans are very susceptible to the effects of space charge. Although the geometries discussed herein should be equally susceptible to the same charge density, storing and detecting a greater number of ions in a larger ion occupied volume will improve both mass accuracy and matrix restricted detection limits.

Although some embodiments use the term "introduced" to describe the process of providing ions into the ion occupied volume of the ion trap mass spectrometer, the same term should be construed to cover formation of ions inside the ion occupied volume. That is, the terms "introduced" or "introducing" covers those scenarios where 1.) ions are created external to the ion trap mass spectrometer and are subsequently brought into the ion occupied volume (i.e., external ionization), and 2.) ions are formed inside the ion occupied volume (i.e., internal ionization).

Although the present invention has been described with reference to these particular embodiments, additional embodiments, applications, and modifications that are obvious to those skilled in the art or are equivalent to the disclosure are included within the spirit and scope of the present invention. Therefore, this invention should not be limited to the specific embodiment discussed and illustrated herein, but rather by the following claims and equivalents thereof.

We claim:

1. An ion trap mass spectrometer for analyzing ions comprising:

a trapping chamber including at least two electrodes shaped to promote an enlarged ion occupied volume, the trapping chamber having a center axis;

means for establishing and maintaining a substantially quadrupole field in the trapping chamber to trap ions within a predetermined range of mass-to-charge ratios;

means for introducing or forming ions in the trapping chamber where the ions are trapped by the substantially quadrupole field;

means for changing the substantially quadrupole field so that the trapped ions of specific masses become unstable and leave the trapping chamber in a direction orthogonal to the center axis;

means for detecting ions after the ions leave the structure; and means for providing an output signal indicative of the mass-to-charge ratio of the detected ion.

2. An ion trap mass spectrometer of claim 1 further comprising a means for establishing and maintaining a supplemental AC field of frequency $f_{res}$ to cause ions of specific mass-to-charge ratios to leave the trapping chamber.

3. An ion trap mass spectrometer of claim 2 further comprising an aperture in at least one electrode through which ions leave the trapping chamber.

4. An ion trap mass spectrometer of claim 2 wherein unstable ions leave the trapping chamber between at least one set of electrodes.

5. An ion trap mass spectrometer of claim 2 further comprising an ion dampening gas.

6. An ion trap mass spectrometer of claim 2 wherein the trapping chamber containing the enlarged ion occupied volume is geometrically configured so that one end of the trapping chamber is connected to the other end of the trapping chamber.

7. An ion trap mass spectrometer of claim 6 wherein the trapping chamber substantially forms a circle.

8. An ion trap mass spectrometer of claim 7 wherein the aperture is located along a portion of the trapping chamber forming a circular face or on a ring for radial ejection.

9. An ion trap mass spectrometer of claim 2 wherein the trapping chamber includes at least two electrodes, one ring electrode and at least one end cap, wherein each electrode is substantially elliptical in shape to contain the enlarged ion occupied volume and the substantially quadrupole field is three-dimensional.

10. An ion trap mass spectrometer of claim 2 wherein the trapping chamber is straight and the substantially quadrupole field is two-dimensional.

11. An ion trap mass spectrometer of claim 2 wherein the trapping chamber is curved and the substantially quadrupole field is two-dimensional and the curvature of the trapping chamber is defined by the ratio $R/r_0$ where $R$=radius of "best fit circle" measured from the center of the "best fit circle" to the center axis of the trapping chamber, and $r_0$=distance from the center axis of the trapping chamber to the vertex of an electrode.

12. An ion trap mass spectrometer of claim 2 wherein the substantially quadrupole field is a three-dimensional substantially quadrupole field.

13. An ion trap mass spectrometer of claim 10 wherein the trapping chamber comprises a central section and at least two end sections.

14. An ion trap mass spectrometer of claim 13 further comprising an elongated aperture located in at least one electrode of the central section through which ions leave the trapping chamber.

15. An ion trap mass spectrometer of claim 13 wherein the difference in the field potential between the central section and the end section is such that the ions are substantially trapped in the central section.

16. An ion trap mass spectrometer of claim 13 wherein the ratio $R/r_0>0$.

17. A method of scanning ions in an ion trap mass spectrometer by using the mass spectrometer of claim 1, comprising the steps:

establishing and maintaining a substantially quadrupole field in which ions within a predetermined range of mass-to-charge ratios can be trapped in the trapping chamber;

introducing ions in the trapping chamber wherein ions within the predetermined range of mass-to-charge ratios are trapped;

changing the substantially quadrupole field so that the trapped ions of specific mass-to-charge ratios become unstable and leave the trapping chamber in a direction substantially orthogonal to a center axis;

detecting the unstable ions after they leave the trapping chamber; and providing an output signal indicative of ion mass-to-charge ratio.

18. A method of scanning ions in an ion trap mass spectrometer by using the mass spectrometer of claim 2, comprising the steps:

establishing and maintaining a substantially quadrupole field in which ions within a predetermined range of mass-to-charge ratios can be trapped in the trapping chamber;

introducing ions in the trapping chamber wherein ions within the predetermined range of mass-to-charge ratios are trapped;

applying a primary supplemental AC field of frequency $f_{res}$ to a set of electrodes, where $f_{res}=kf\pm f_u$ $k$=integer where $k=\{0, \pm 1, \pm 2, \pm 3, \ldots\}$ $f$=frequency of the RF component of the substantially quadrupole field $f_u$fundamental frequency for the secular motion of a given ion at $q_{u\ eject}$ along the u coordinate axis, and $f_u<f$, the primary supplemental AC field superimposed on the substantially quadrupole field to form a combined field so that trapped ions of specific mass-to-charge ratios develop unstable trajectories that cause them to leave the trapping chamber;

changing the combined field so that at least a portion of the remaining trapped ions of specific mass-to-charge ratios become unstable and leave the trapping chamber in a direction substantially orthogonal to a center axis;

detecting the unstable ions after they leave the trapping chamber; and providing an output signal indicative of ion mass-to-charge ratio.

19. A method of scanning ions as in claim 18 wherein the combined field is changed by changing the magnitude of the substantially quadrupole field.

20. A method of scanning ions as in claim 18 wherein the combined field is changed by changing the frequency f of the substantially quadrupole field.

21. A method of scanning ions as in claim 18 wherein the combined field is changed by changing the magnitude of the primary supplemental AC field while changing the amplitude of the RF component of the substantially quadrupole field.

22. A method of scanning ions as in claim 18 wherein the combined field is changed by changing the frequency $f_{res}$ of the primary supplemental AC field.

23. A method of scanning ions in an ion trap mass spectrometer by using the mass spectrometer of claim 2, comprising the steps:

establishing and maintaining a substantially quadrupole field in which ions within a predetermined range of mass-to-charge ratios can be trapped in the trapping chamber;

introducing ions in the trapping chamber wherein ions within the predetermined range of mass-to-charge ratios are trapped;

changing the substantially quadrupole field so that the trapped ions of specific mass-to-charge ratios become unstable and leave the trapping chamber so that the remaining selected or isolated ions in the trapping chamber can be further manipulated;

adjusting the substantially quadrupole field to be able to trap product ions of the remaining ions in the trapping chamber;

dissociating or reacting remaining ions with a neutral gas to form product ions;

changing the substantially quadrupole field to remove, for detection, ions whose mass-to-charge ratios lie within a desired range of mass-to-charge ratios;

detecting the ions after they leave the trapping chamber in a direction substantially orthogonal to a center axis; and providing an output signal indicative of the removed ion mass-to-charge ratio.

24. A method of scanning ions as in claim 23 wherein the step of removing ions from the trapping chamber into a detector further includes the steps:

applying a supplemental AC field superimposed on the substantially quadrupole field to form a combined field;

changing the combined field to remove, for detection, ions whose mass-to-charge ratios lie within a desired range of mass-to-charge ratios.

25. A method of scanning ions as in claim 24 wherein the combined field is changed by changing the frequency of the supplemental AC field.

26. A method of scanning ions as in claim 24 wherein the combined field is changed by changing the magnitude of the substantially quadrupole field.

27. A method of scanning ions as in claim 24 wherein the combined field is changed by changing the frequency f of the substantially quadrupole field.

28. A method of scanning ions as in claim 24 wherein the combined field is changed by changing the magnitude of the supplemental AC field while changing the amplitude of the RF component of the substantially quadrupole field.

29. A method of scanning ions in an ion trap mass spectrometer, comprising the steps:

establishing and maintaining a substantially quadrupole field in which ions within a predetermined range of mass-to-charge ratios can be trapped in the trapping chamber;

introducing ions in the trapping chamber wherein ions within the predetermined range of mass-to-charge ratios are trapped;

creating an enlarged ion occupied volume without an increase in space charge within a trapping chamber;

changing the substantially quadrupole field so that the trapped ions of specific mass-to-charge ratios become unstable and leave the trapping chamber in a direction substantially orthogonal to a center axis;

detecting the unstable ions after they leave the trapping chamber; and providing an output signal indicative of ion mass-to-charge ratio.

* * * * *